United States Patent [19]

Matsuura et al.

[11] Patent Number: 4,978,887

[45] Date of Patent: Dec. 18, 1990

[54] SINGLE ENDED METAL VAPOR DISCHARGE LAMP WITH INSULATING FILM

[75] Inventors: Atsushi Matsuura; Kazuo Honda; Shinji Inukai; Hisanori Sano, all of Kanagawa, Japan

[73] Assignee: Toshiba Lighting & Technology Corporation, Yokosuka, Japan

[21] Appl. No.: 314,104

[22] Filed: Feb. 23, 1989

[30] Foreign Application Priority Data

Feb. 26, 1988 [JP] Japan ..... 63-42253

[51] Int. Cl.[5] ..... H01J 61/35

[52] U.S. Cl. ..... 313/635; 313/44; 313/113; 313/621

[58] Field of Search ..... 313/44, 113, 621, 623, 313/635

[56] References Cited

U.S. PATENT DOCUMENTS

| | | | |
|---|---|---|---|
| 3,753,019 | 8/1973 | Hellman | 313/47 |
| 4,307,315 | 12/1981 | Meulemans et al. | 313/44 |
| 4,308,483 | 12/1981 | Keeffe et al. | 313/621 |
| 4,415,829 | 11/1983 | Rothwell, Jr. et al. | 313/621 |
| 4,490,642 | 12/1984 | Dobrusskin et al. | 313/25 |
| 4,612,000 | 9/1986 | English et al. | 313/631 X |

OTHER PUBLICATIONS

Japanese Provisional Publication No. 163956/82, Publication Date: Oct. 8, 1982.

Japanese Provisional Publication No. 54167/84, Publication Date: Mar. 28, 1984.

Japanese Provisional Publication No. 232662/85, Publication Date: Nov. 19, 1985.

"Metal Halide Lamps", pp. 237–248, Lamps and Lighting, 3rd Edition, 1983.

"Production of Radiation", pp. 110–116, Lamps and Lighting, 3rd Edition, 1983.

*Primary Examiner*—Donald J. Yusko

*Assistant Examiner*—Michael Horabik

*Attorney, Agent, or Firm*—Cushman, Darby & Cushman

[57] ABSTRACT

A metal vapor discharge lamp has an envelope formed of a vitreous high temperature resistant material. A pair of electrodes each has a metal rod and an arc supporting electrode. The metal rods are sealed at one end of the envelope. The envelope is filled with a starting gas and a charge. The present invention also includes insulating films formed on the envelope behind the arc supporting electrodes to increase the vapor pressure of the charge, and improve output and the spectral color distribution.

4 Claims, 2 Drawing Sheets

SINGLE ENDED METAL VAPOR DISCHARGE LAMP WITH INSULATING FILM

FIELD OF THE INVENTION

The present invention relates to a metal vapor discharge lamp and method of manufacturing the same. More particularly, it relates to a single-ended metal vapor discharge lamp and a method of manufacturing the same.

BACKGROUND OF THE INVENTION

The high intensity discharge lamp has conventionally been used for outdoor or factory illumination. Among desirable features of these lamps are a very favorable spectral color distribution, high efficiency, much smaller size and the least property changes with changes in its lighting angle. Such lamps may be used for illuminating the inside of structures such as stores. An improvement over these features is provided by the use of a single ended metal vapor discharge lamp as a light source. For example, U.S. Pat. No. 4,415,829 describes a miniature direct current lamp and a structure of electrodes to maintain the desired cathode temperature. U.S. Pat. No. 4,308,483 teaches a lamp having a pair of electrodes whose terminal ends define an arc region having a given distance therebetween. This lamp is smaller in size and of increased brightness. U.S. Pat. No. 4,612,000 teaches a process for manufacturing a single-ended metal vapor discharge lamp, and discloses an isothermal operational condition with a fused silica envelope forming the discharge lamp. All of these improvements prevent particular problems, but problems still exist with these lamps. When these lamps are operated, the temperature of the coldest portion in the luminous bulb is likely to decrease greatly and prevent sufficient vaporization of the charge thereof when the direction of the lamp arc is changed, particularly by 90° from a vertical to a horizontal position. This causes lamp properties, such as luminous efficiency and spectral color distribution, to be reduced by more than 20% in relative value.

SUMMARY OF THE INVENTION

It is an object of present invention to provide a metal vapor discharge lamp of the one side sealed type having high efficiency. Another object of the present invention is to provide a metal vapor discharge lamp of the one side sealed type having a very favorable spectral color distribution.

A further object of the present invention is to provide a metal vapor discharge lamp of the one side sealed type which is much smaller in size.

A still further object of the present invention is to provide a metal vapor discharge lamp of the one side sealed type with less irregularities in lamp properties as the arc therein changes angles.

To accomplish the above-described objects, a metal vapor discharge lamp according to the present invention includes an envelope formed of vitreous high temperature resistant material, a pair of electrodes each having a metal rod and an arc supporting electrode, each of said metal rods being sealed at one end of said envelope, and insulating films formed on said envelope which are located behind said electrodes.

BRIEF DESCRIPTION OF DRAWINGS

Other objects and advantages of the present invention will be apparent from the following detailed description of the presently preferred embodiment taken in conjunction with the accompanying drawings, in which.

DETAILED DESCRIPTION OF THE PREFERRED EMBODIMENT

Figure 1:
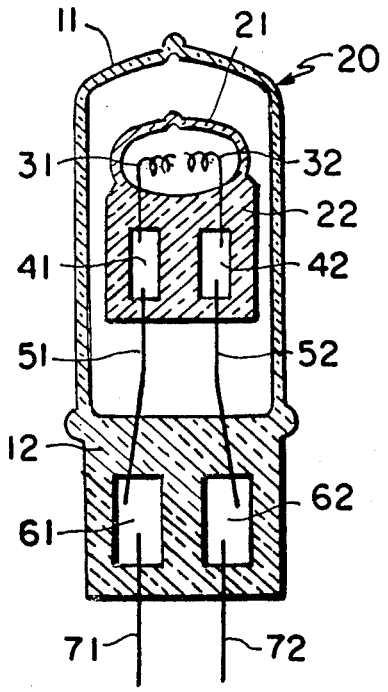
FIG. 1 shows a metal vapor discharge lamp to which a luminous bulb of the present invention is applied.

A preferred embodiment of the present invention will now be described hereafter by referring to accompanying drawings. FIG. 1 shows a metal halide lamp to which a luminous bulb of the present invention is applied. The metal vapor discharge lamp shown in FIG. 1 includes outer bulb 11, luminous bulb 20 housed in outer bulb 11, and sealing sections 12 and 22 of these two bulbs. Outer bulb 11 is made of quartz glass and has sealing section 12 located on only one side thereof. A base (not shown) is usually attached to sealing section 12 of outer bulb 11. Luminous bulb 20 includes bulb body (envelope) 21, main electrodes 31 and 32, having metal rods 33 and 34 and arc supporting electrodes 35 and 36, respectively, sealing section 22, metal foils 41 and 42, and lead lines 51 and 52. Luminous bulb 20 is also of the one side sealed type since sealing section 22 is formed on only one side of bulb body (envelope) 21. The volume of bulb body 21 is 0.5 cc. Electrodes 31 and 32 are each made of thoriated tungsten, for example, have a diameter of 0.5 mm and are arranged inside bulb body 21. Arc supporting electrodes 35 and 36 of electrodes 31 and 32 are separated from each other by about 6.8 mm and are opposed to each other in the bulb body 21 in the direction of the bulb axis.

Figure 2:
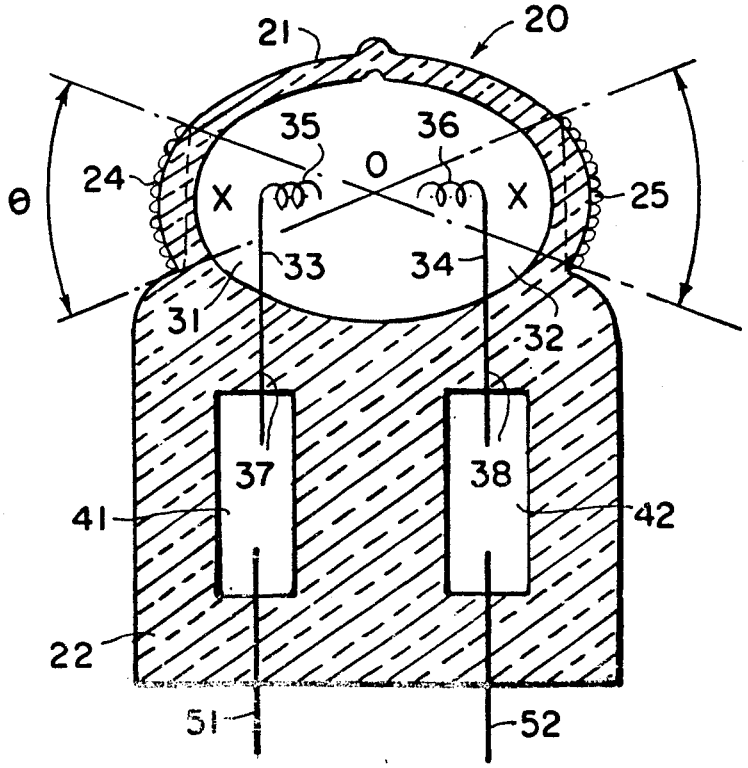
FIG. 2 is a vertically-sectioned view showing an example of the luminous bulb according to present invention.

Referring to FIG. 2 insulating films 24 and 25 are formed on the outer surface of luminous bulb body 21 behind arc supporting electrodes 35 and 36 of electrode 31 and 32. These insulating films 24 and 25 are made of metal oxide materials, for example $Al_2O_3$, $TiO_2$, $SiO_2$ and $ZrO_2$ or the like and coated on the outer face of the bulb body 21 behind coil portions 35 and 36 of electrodes 31 and 32.

Insulating films 24 and 25 are coated on bulb body 21 in a predetermined conical angle $\theta$ whose apex is the center 0 of bulb body 21, and arc supporting electrodes 35 and 36 of the electrodes 31 and 32 are naturally in the areas of this conical angle $\theta$.

Base ends 37 and 38 of metal rods 33 and 34 are connected to metal foils 41 and 42 such as Mo(Molybdenum), respectively embedded in sealing section 22. One end of each of lead wires 51 and 52 is also connected to one of metal foils 41 and 42, respectively. The other end of each of luminous bulb lead wires 51 and 52 is respectively connected to one of metal foils 61 and 62 such as Mo, air-tightly embedded in sealing section 12 of outer bulb 11. Further, outer bulb lead wires 71 and 72 are connected to these metal foils 61 and 62.

A suitable filling for luminous bulb 21 comprises argon or other inert gases at a pressure ranging from several torr to a few hundred torr to serve as a starting gas, mercury as a buffer gas, and a charge comprising at least one of tin iodide($SnI_2$), thallium iodide(TlI), indium iodide(InI), sodium iodide(NaI), sodium bromide(NaBr) and lithium bromide(LiBr), for example.

A voltage is applied to the paired main electrodes, and a discharge is generated between the paired arc supporting electrodes whereby light is emitted. The intensity of this output increases and the spectral color distribution improves as the vapor pressure of the sealed charging gas increases. It is also well known that the vapor pressure of the charge is determined by the bulb wall temperature of the coldest portion in the bulb body 21. It can therefore be said that the lamp properties, such as intensity of the output and spectral color distribution, are determined by the bulb wall temperature.

According to this embodiment of the present invention, arc discharge between arc supporting electrodes 35 and 36 of paired electrodes 31 and 32 is generated between electrodes 31 and 32 during operation. Therefore, depending upon the angular orientation of the operated lamp, the regions x (illustrated in FIG. 2) of bulb body 21 behind arc supporting electrodes 35 and 36 of electrodes 31 and 32 tend to run cool. This is because regions x are remote from the hot central arc generated between the paired arc supporting electrodes 35 and 36 of electrodes 31 and 32, and these regions do not face the hot central arc. Particularly when the lamp is oriented so that the arc is horizontal, the temperature of the bulb body decreases further.

However, in this invention, since insulating films 24 and 25 are formed on the outer surface of portions x, insulating films 24 and 25 reflect the radiated heat coming from the arc discharge generated between electrodes 31 and 32 to raise the temperature of regions x. Metal halide, which tends to condense at regions x, is more likely to evaporate to raise the vapor pressure in the bulb body 21, so that the luminous efficiency and spectral output or color can be improved. The heat reflected by films 24 and 25 prevents the temperature at regions x from being lowered depending upon the orientation of the operated lamp.

Figure 3A:
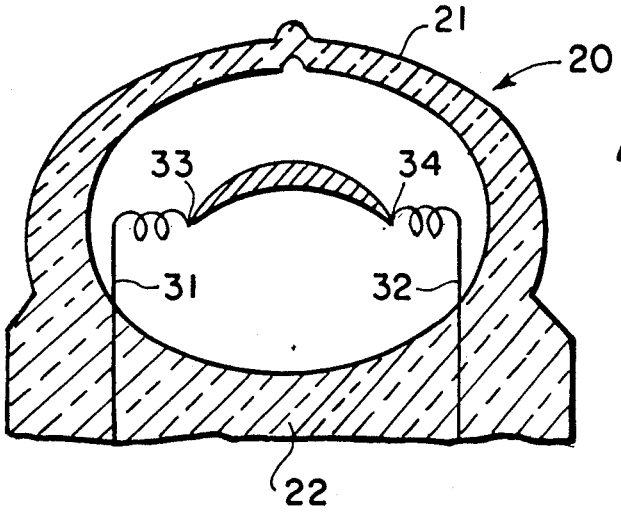
FIGS. 3A and 3B show examples of a lighting angle of 0° (the arc extends in a horizontal direction)
Figure 3B:
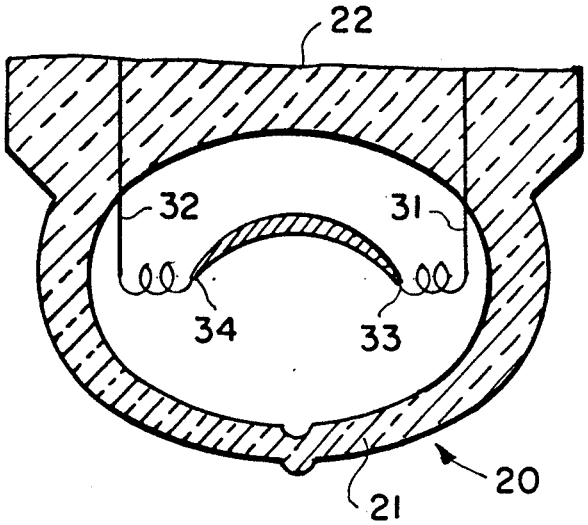
Figure 3C:
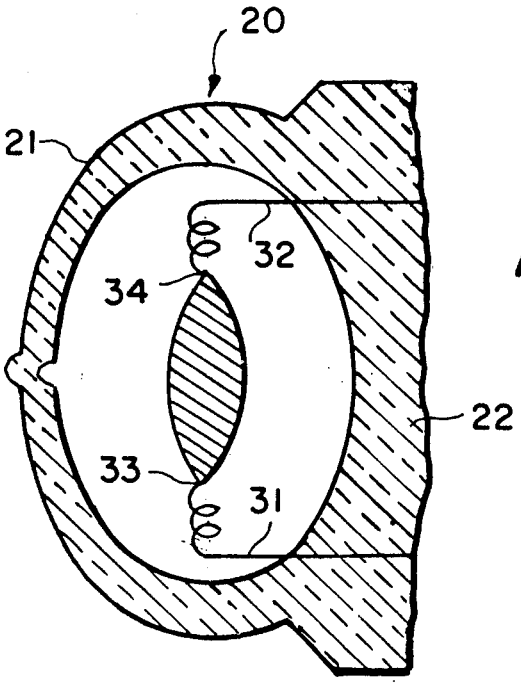
FIG. 3C shows a lighting angle of 90° (the arc extends in a vertical direction).

The areas on the bulb body 21 where insulating films 24 and 25 are coated have a conical angle $\theta$ of 10°–30° respectively whose apex is center 0 of bulb body 21. This reason will be described. The following tables show test results relating to how the luminous efficiency and the color of the lamp changes when the areas on the bulb body 21 where insulating films 24 and 25 are formed are changed in the case of a lighting angle of 0° (arc is horizontal direction) and 90° (arc is vertical direction) as illustrated in FIGS. 3A to 3C.

As apparent from the tables, the heat-insulating effect is enhanced as the regions coated by insulating films 24 and 25 become larger. The luminous efficiency and the spectral color distribution of the lamp are thus improved. When the regions coated by the insulating films 24 and 25 become too large, the amount of output is lowered because the insulating films 24 and 25 interrupt the output from the bulb body 21.

TABLE A

| | (Case of lighting angle Θ = 0°) | |
|---|---|---|
| Conical Angle Θ | Luminous Efficiency % (Values relative to lamps having no insulating films) | Spectral Color Distribution Ra % (Values relative to lamps having no insulating films) |
| 5° | 100 | 100 |
| 10° | 105 | 102 |
| 20° | 108 | 104 |
| 30° | 105 | 106 |

TABLE A-continued

| | (Case of lighting angle Θ = 0°) | |
|---|---|---|
| Conical Angle Θ | Luminous Efficiency % (Values relative to lamps having no insulating films) | Spectral Color Distribution Ra % (Values relative to lamps having no insulating films) |
| 40° | 95 | 110 |

TABLE B

| | (Case of lighting angle Θ = 90°) | |
|---|---|---|
| Conical Angle Θ | Luminous Efficiency % (Values relative to lamps having no insulating films) | Spectral Color Distribution Ra % (Values relative to lamps having no insulating films) |
| 5° | 100 | 100 |
| 10° | 110 | 104 |
| 20° | 115 | 109 |
| 30° | 107 | 112 |
| 40° | 98 | 115 |

It is therefore desirable that the location of coated insulating films 24 and 25 are in a conical angle $\theta$ of 10°–30° whose apex is center 0 of the bulb body 21.

When insulating films 24 and 25 are coated in these regions, they reflect radiation from the generated arc discharge in these regions x (caused by the heat-insulating effect), thereby raising the temperature of these regions x of the bulb body. The ordinary effect of increasing the temperature of these regions is, of course, to increase the vapor pressures of the charge and this results in increased output and a warmer color, that is more red. Even when the lamp is positioned so that the generated arc is horizontal, the lamp provides sufficient vaporization of the charge, whereby luminous efficiency and the color warmth are improved. However, the colder regions of bulb 20 move to the shoulder portions of sealing section 22 which becomes a main cause of heat loss. However, since these shoulder portions face the arc, a temperature of these shoulder portions provides sufficient vaporization of the charge.

While the invention has been set forth herein with respect to a certain embodiment and specific example thereof, many modifications and changes will readily occur to those skilled in the art. The present invention can be applied not only to the metal halide lamp which has been described above, but also to any of those metal vapor discharge lamps which have a bulb body of the one side sealed type.

What is claimed is:

1. A metal vapor discharge lamp comprising:

an envelope formed of a vitreous high temperature resistant material;

a pair of electrodes each having an arc supporting electrode, each of said electrodes being sealed at one end of said envelope;

a charge filling said envelope; and at least one insulating film formed on said envelope behind at least one of said arc supporting electrodes to increase the vapor pressure of said charge and to improve output and spectral color distribution, said at least one insulating film covering an area defined by a conical angle of 10°–30°, the apex of which is the center of said envelope.

2. A metal vapor discharge lamp according to claim 1, wherein said charge comprises at least one of tin iodide, thallium iodide, indium iodide, sodium iodide, sodium bromide and lithium bromide.

3. A metal vapor discharge lamp according to claim 1 wherein said at least one insulating film includes a plurality of insulating films, one of said insulating films being formed on said envelope behind each of said arc supporting electrodes, respectively.

4. A metal vapor discharge lamp according to claim 3, wherein said insulating films cover areas defined by a conical angle of 10°–30°, the apex of which is the center of said envelope.

* * * * *